United States Patent [19]

Neufeldt

[11] 4,057,154

[45] Nov. 8, 1977

[54] REFUSE COMPACTING VEHICLE

[76] Inventor: Allen Abram Neufeldt, 85 Nymark Avenue, Willowdale, Ontario, Canada, M2J 2H1

[21] Appl. No.: 771,571

[22] Filed: Feb. 24, 1977

[51] Int. Cl.[2] ..... B65F 3/00

[52] U.S. Cl. ..... 214/82; 214/83.3

[58] Field of Search ..... 214/82, 83.3, 78, 503

[56] References Cited

U.S. PATENT DOCUMENTS

| | | | |
|---|---|---|---|
| 2,439,001 | 4/1948 | Hippard | 214/82 X |
| 3,161,305 | 12/1964 | Ferrari et al. | 214/82 |
| 3,584,755 | 6/1971 | Smith | 214/83.3 |

*Primary Examiner*—Albert J. Makay

[57] ABSTRACT

A refuse carrier is described of the type consisting of a motor vehicle having a compartment adapted to receive and compact refuse. The novel feature relates to a loading and compacting mechanism comprising a pusher-blade extending across a lower portion of the compartment with a telescopic hydraulic cylinder for moving the pusher-blade horizontally backward and forward between a refuse-receiving position and refuse-compacting position. A bucket is pivotally mounted along the upper edge of the blade for pivotal movement between a lower refuse-receiving position and an upper refuse-discharging position. One or more cam wheels is articulated between the bucket and the blade by means of pivotal arms and a cam guideway forms an incline path between a lower refuse-receiving position and an upper refuse-discharging and compacting position. The cam wheel in response to movement of the pusher-blade in a compacting direction travels up the guideway, thereby forcing the bucket to swing from a lower horizontal refuse-receiving position to an upper vertical refuse-discharging position, with the bucket in the vertical position acting as a vertical extension of the compacting blade during continued movement of the blade in compacting direction. With the bucket in this vertical position, it can also serve as a pusher for emptying all of the refuse from the container.

11 Claims, 9 Drawing Figures

REFUSE COMPACTING VEHICLE

BACKGROUND OF THE INVENTION

1. Field of the Invention

This invention relates to a self-loading and compacting refuse carrier and, in particular, to a compactor vehicle which can be loaded from the side.

2. Description of the Prior Art

A variety of specially designed vehicles for tansporting refuse have been known for many years. These usually include some form of closed refuse-receiving compartment and an automatic refuse-loading and compacting assembly. Typically this loading and compacting assembly forms a tailgate at the rear of the vehicle and may be hinged at an upper point of the body so that the assembly may be rotated out of the way by hydraulic cylinders when the vehicle is to be emptied. The assembly also includes a refuse-receiving bucket together with an arm and scraper to force the material from the bucket into the vehicle compartment. This loading and compacting assembly is large, complex and extremely heavy. The result is that the heaviest part of the load is the vehicle itself and, because of the very heavy structure at the rear of the vehicle, a very heavy-duty vehicle must be used which is expensive not only in terms of initial purchase, but continues to be expensive in terms of maintenance and fuel.

Recently a number of relatively light-weight refuse vehicles have been appearing on the market which are normally operated by one or two men. These are designed for use with a relatively light-weight vehicle chassis and have been designed to provide only a minimum of compaction. One such vehicle is described in Canadian Pat. No. 890,260, issued Jan. 11, 1972. It will be noted that the patent shows a side loading bucket and this is certainly desirable for small crews since, with a one-man crew the driver can stop directly beside the refuse, step out of his cab, throw the refuse into the bucket and get back into the cab without having to go back and forth to the rear of the vehicle. This represents a great saving in time and effort.

However, the great disadvantage of the loader shown in the above patent is that as can be seen from FIG. 4, the bucket projects out from the side of the vehicle a considerable distance at a quite low elevation. Unless the driver is careful to retract the bucket at all times while he is moving along a street, there is a great danger of another vehicle running into the bucket and, therefore, it may present a very serious hazard.

Other side loading vehicles have recently appeared on the market which avoid the hazard of the bucket swinging out to the side by having a refuse-receiving door in the side of the vehicle compartment. However, these have been rather unsatisfactory vehicles because of very small receiving section for refuse, making the actual procedure of dumping refuse containers into the vehicle very awkward.

It is the object of the present invention to provide a refuse carrier which can overcome the above problems by providing a vehicle which combines four very desirable features, namely light-weight, side laoding, spacious loadind compartment and effective compaction.

SUMMARY OF THE INVENTION

The refuse carrier of the present invention is of the type comprising a motor vehicle having a compartment adapted to receive and compact refuse. The novel feature relates to a loading and compacting mechanism which includes a pusher-blade extending across a lower portion of the compartment between opposite side walls and means for moving the pusher-blade horizontally backward and forward between a refuse-receiving position and a refuse-compacting position. A bucket is pivotally mounted along the upper edge of the blade for pivotal movement between a lower refuse-receiving position and an upper refuse-discharging position. At least one cam wheel is articulated between the bucket and the blade by means of pivotal arms and a cam guideway forms an incline path between a lower refuse-receiving position and an upper refuse-discharging and compacting position. The cam wheel is arranged so that in response to movement of the pusher-blade in a compacting direction it travels up the guideway, thereby forcing the bucket to swing from a lower horizontal refuse-receiving to an upper vertical refuse-discharging position. The bucket in this vertical position then continues to act as a vertical extension of the compacting blade during continued movement of the blade in compacting direction.

DESCRIPTION OF THE PREFERRED EMBODIMENTS

Preferably the vehicle includes a separate refuse-receiving compartment which is positioned immediately behind the cab of the vehicle and immediately in front of the compacting compartment. This refuse-receiving compartment has openings in the side of the vehicle immediately behind the cab, these openings being closable by doors.

According to another preferred feature, a pair of cam wheels and cam guideways are used, these being positioned adjacent each side of the vehicle frame. The compactor blade is preferably moved backward and forward by means of a telescopic hydraulic cylinder. The loader and compactor of this invention can be operated with a single hydraulic cylinder and this represents one of the important advantages of the present invention. Thus, the requirement of only a single cylinder is a very significant feature both in decreasing capital cost for the vehicle and maintenance cost.

For emptying the vehicle, either rear doors or side doors can be used, but it is particularly advantageous to use a rear door since the pusher-blade and bucket in vertical position can then be used as a combined pusher for pushing the compacted load out the rear opening.

According to another preferred feature, the bucket can also be provided with a special design so as to provide a relatively low garbage receiver. Thus, a single bucket is used which extends across the full width of the compartment but is provided with a high central hump portion which extends over the hydraulic cylinder and vehicle frame and at a pair of deep garbage receiving pockets on each side of this central hump, the bottoms of which extend down below the level of the vehicle frame. The ends of the bucket can then be sufficiently low to provide easy accessibility from ground level.

BRIEF DESCRIPTION OF THE DRAWINGS

One preferred embodiment of the invention is illustrated by the accompanying drawings in which:

With reference to FIG. 1 there is illustrated a truck having a conventional main frame 10 and a cab 11 which houses a prime mover connected to a power drive train to power the rear wheels 12. Mounted on the frame 10 is a body portion including a packer or compacting section 13 and a loading section 14. It also includes a swinging tailgate 15.

Figure 1:
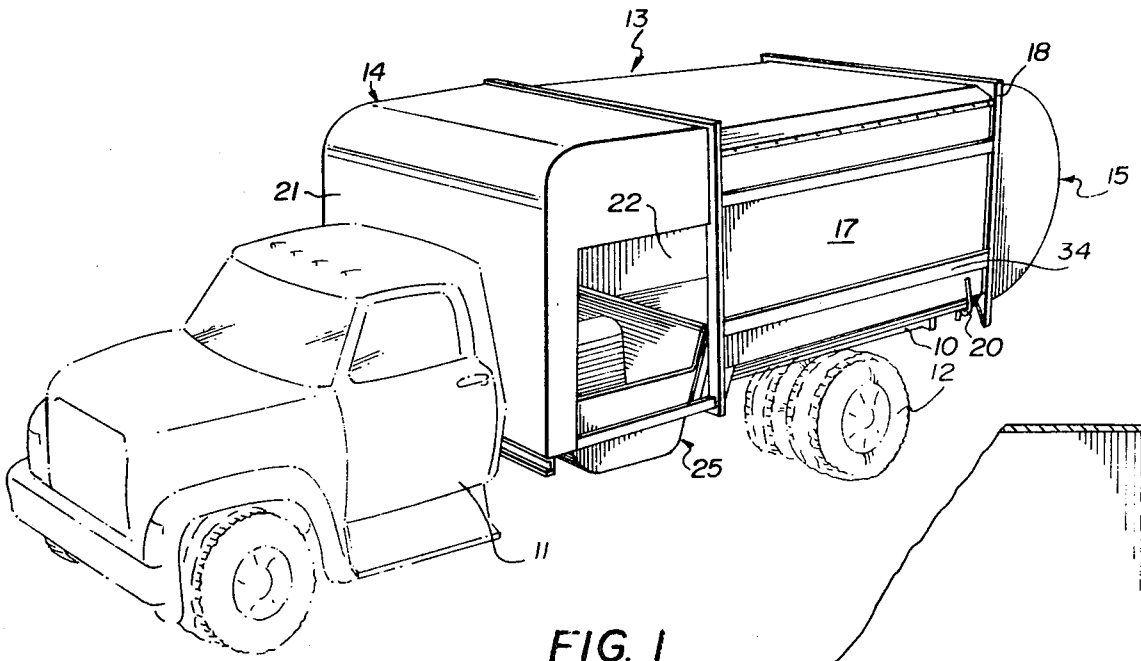
FIG. 1 is a perspective view of a vehicle according to the present invention with the bucket in refuse-receiving position.

The body may typically be formed of tubular steel posts to which sheet metal plates of suitable sizes are welded. It includes a rigid floor section 16 with side walls 17 of sheet metal plates and tubular steel posts 18. The tailgate 15 is hinged from the top by means of hinges 19 and is held in closed position by means of a pair of releasable latches 20. The tailgate can be flat or it may bulge rearwardly as illustrated to provide additional load carrying capacity.

The body of the truck is entirely covered by a roof portion which extends along horizontally over the compacting section and merges into a front end wall 21. This wall 21 also forms the front end wall of the loading compartment 14. The loading compartment has large side openings 22 which can be closed by doors, preferably mounted for sliding on tracks. Particularly preferred are folding doors which travel on tracks within compartment 13 between a closed position covering openings 22 and an open position adjacent end wall 21.

Positioned within the loading section 14 is the loading and compacting bucket 25. This bucket is made from sheet metal and includes an inclined rear wall 26, a bottom wall 27, an inclined front wall 28 and end walls 29. A high rounded hump portion 31 is provided in the middle of the bucket effectively dividing the bucket into two separate garbage receiving pockets 30. The humped portion 31 extends over the truck frame so that the pockets 30 are positioned quite low on each side of the truck frame at an elevation which permits easy loading by a loader standing on the ground.

The rear wall 26 is reinforced by means of vertical stiffening bar 64 and horizontal stiffening bars 65. Additional plates 48 are mounted on rear wall 26 for the purpose of connecting the bucket to the remainder of the actuating mechanism.

Figure 6:
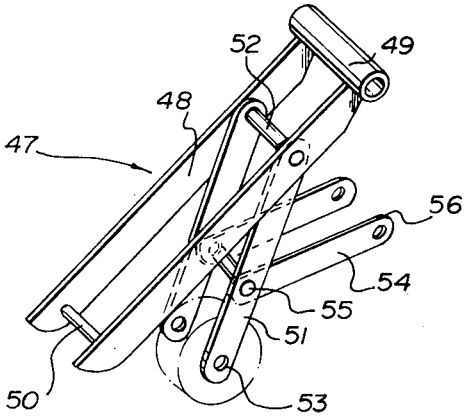
FIG. 6 is a perspective view showing details of an actuating arm.
Figure 7:
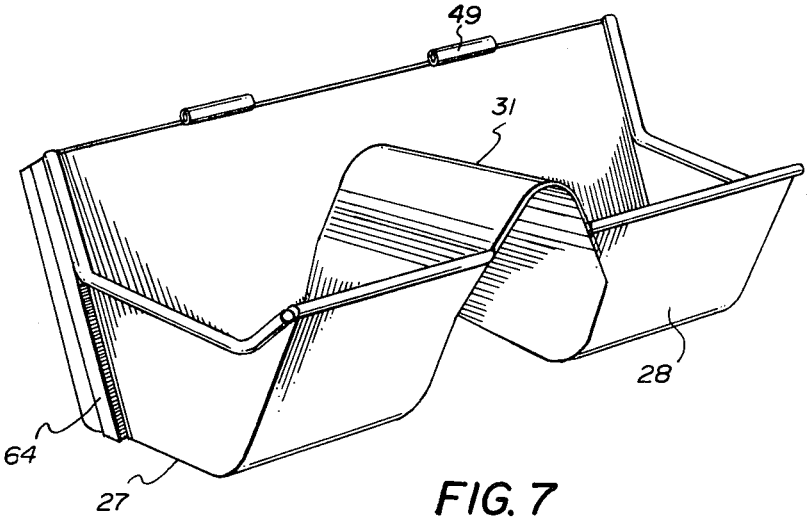
FIG. 7 is a perspective view showing details of the pusher-blade and bucket.
Figure 8:
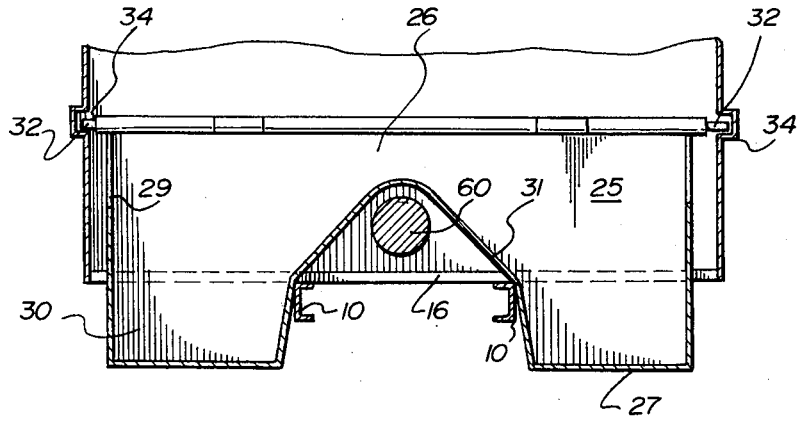
FIG. 8 is a sectional elevation through the bucket.

As can best be seen from FIG. 6 which shows an assembled actuating arm mechanism, the plates 48 are arranged in pairs with each pair being joined at the top by a short tubular section 49 and joined at the bottom by a connecting rod 50. The actuating arm assembly is then connected to the plates 48 and the bucket by means of pivot pin 52.

The tubular members 49 form part of a hinge connection for pivotally connecting the bucket 25 to a pusher-blade assembly 33. These are joined together by means of a pivot rod 32 and, in order to prevent the pusher-blade assembly from lifting from its normal position resting on the floor 16, the ends of the rod 32 are preferably mounted in horizontal slots 34 extending along the length of the side wall panel 17.

Figure 4:
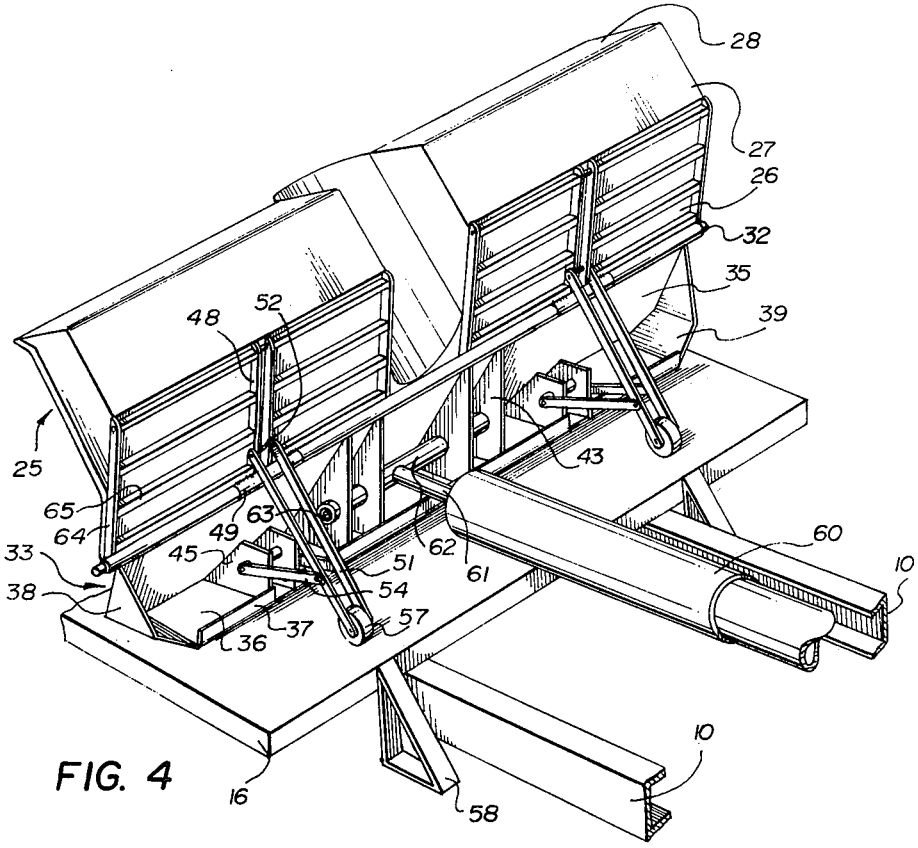
FIG. 4 is a perspective view showing the bucket in vertical dumping and compacting position.
Figure 5:
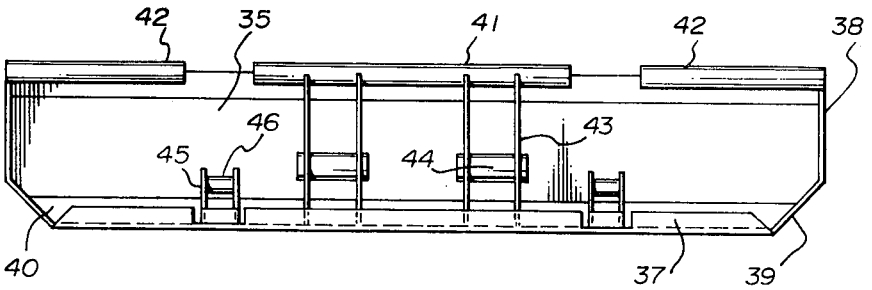
FIG. 5 is a rear elevation of the pusher-blade.

The details of the pusher-blade assembly can best be seen from FIGS. 4 and 5. This pusher-blade assembly includes an inclined front plate 35, a bottom plate 36 and a rear flange 37 all formed from flat metal stock, e.g. 3/16 inch steel flat stock. The ends of the pusher-blade are formed from a heavy steel flat stock, e.g. ½ inch stock, and includes a vertical upper plate 38 and an inclined lower plate 39. The bottom of the lower plate 39 is connected to the end of bottom plate 36 while the front edges of the plates 38 and 39 are joined to the inclined front plate 35. Extending along a central portion of the bottom plate 36 is a heavy stiffener bar 40 which can, for instance, be made from ¾ inch steel stock.

Mounted along the top of the pusher-blade are a central tubular section 41 and two end tubular sections 42. The pair of gaps between the central section 41 and the end section 42 receive the tubular sections 49 mounted on the bucket. The pivot rod 32 then extends from end to end through these tubular sections 41, 42 and 49.

The actuating arm assembly 47 is connected between the pusher-blade and bucket and as can best be seen from FIGS. 4 and 6, the actuating arm assembly includes a pair of parallel spaced steel arms 51 pivotally connected at their upper end to the bucket by means of pivot pin 52. Holes 53 are provided at the lower ends of these arms 51 with a wheel 57 being mounted between these lower ends and an axle extending through the holes 53. A pair of short arms 54 are mounted at an intermediate region of the rods 51 by means of pivot pin 55 with the other ends of these rods 54 being connected to the pusher-blade by means of a pivot pin extending through the holes 56.

For connecting these to the pusher-blade, there is provided in the pusher-blade assembly pairs of steel plates 45 connected by a short tubular section 46. This assembly on the pusher-blade then fits between the plates 54 of the actuating arm and a pivot pin extends through the holes 56 and the tubular member 46.

An inclined guideway or ramp 58 is mounted on each side of the vehicle frame 10. Each ramp provides an inclined path up to the body floor 16. These ramps serve as cam guideways for the wheels 57 which are effectively cam wheels.

The guideways and cam wheels represent an important feature of this invention in that they provide the means for both loading and compacting by the use of a single hydraulic cylinder. This cylinder 60 is a telescoping cylinder having a rod 61 with a tubular end connector portion 62 and the cylinder 60 being connected to the truck frame by way of connector 63.

For the purpose of connecting this cylinder rod 61 to the pusher-blade, the pusher-blade assembly includes plate members 43 with tubular members 44 mounted therebetween. The connector 62 mounted on the end of rod 61 is positioned between the tubular members 44 and a pivot rod then extends all the way through the tubular members 44 and the tubular connector 62.

OPERATION OF THE SYSTEM

Figure 2:
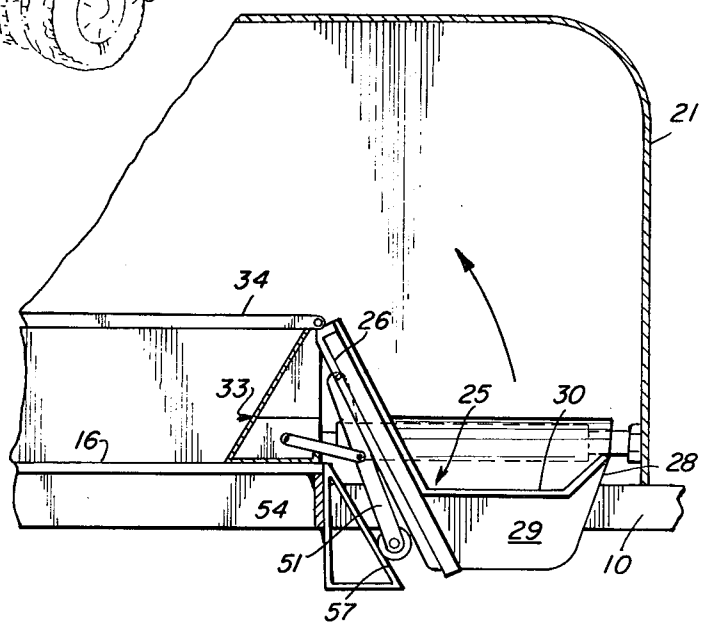
FIG. 2 is a view showing the bucket actuating mechanism.
Figure 3:
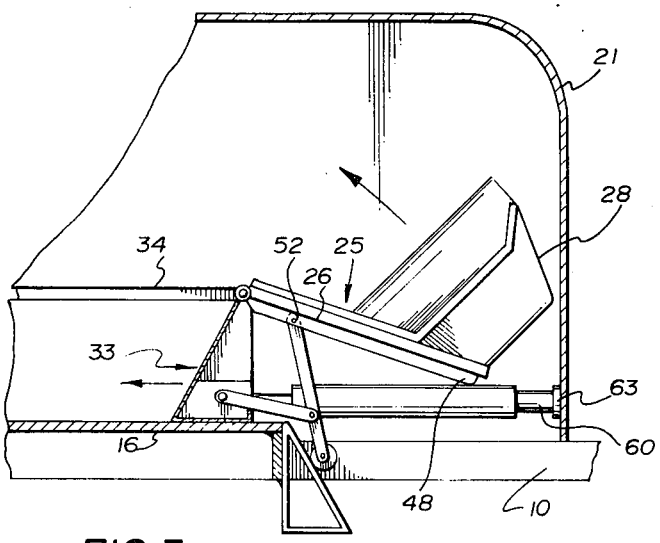
FIG. 3 is a view showing the bucket during its swing.

FIGS. 1 and 2 show the bucket in refuse-receiving position. In this position the wheels 57 are resting on a lower portion of the inclined guideways 58. Then as cylinder 60 commences to push on the pusher-blade assembly, the wheels 57 commence to travel up the inclined guideways 58 as shown in FIG. 3 and this commences the tipping action of the bucket 25. Additional guides or rollers may be mounted on the side walls of the vehicle to assist in the travel of the bucket. When the wheels have completed their travel up the inclined guideways 58 and have moved onto the floor 16 of the compartment, the bucket has been forced into the vertical position as shown in FIG. 4. Stops can be provided to prevent the bucket from continuing its swing beyond this vertical position.

In the vertical position, the bucket dumps the refuse contained in the pockets 30 into the compartment 13. Then, as the pusher-blade assembly continues its movement in a rearward direction, the bucket becomes a vertical extension of the blade 33, thereby forming a compacting blade which fills the entire cross-section of the compacting section. Thus, it will be seen that this assembly provides the unique combination of a light-weight vehicle which can provide a high degree of compaction so that the light-weight vehicle becomes practical for hauling refuse to relatively distant dumps.

Figure 9:
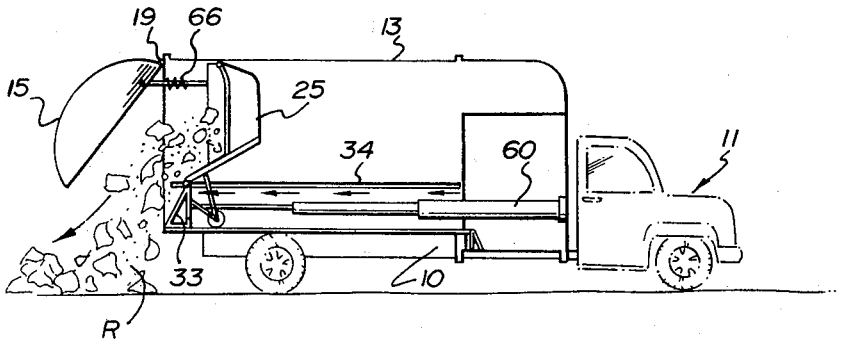
FIG. 9 is an elevation view of a vehicle in unloading position.

The emptying of the compartment is shown in FIG. 9 and it will be seen that with the tailgate 15 in an open position, the pusher-blade and bucket combination act as a pusher for quickly and conveniently emptying the compartment. In order to simplify the unloading of the last portions of the refuse R, it is advantageous to provide a slide-bar 66 which is engaged by the top corner of the bucket 25 as it approaches the rear end of the compartment and serves as a pusher which it engages the tailgate 15, holding it in open position while the last portions of the refuse R tumble out.

From the above detailed description, a number of important advantages to the assembly of the present invention become evident. Firstly, the use of a single cylinder for loading, compacting and unloading is a very significant saving in initial cost, vehicle weight and maintenance. Secondly, by being able to position the cylinder in a central region of the vehicle, all of the moving parts are contained within the vehicle body and there are no hazardous exposed moving parts along the sides or at the rear of the vehicle. A further advantage of having no moving parts exposed on the sides of the vehicle is that the doors to the garbage receiving compartment can be mounted to slide on tracks so that there is never the danger of these swinging open.

The very high hump 31 in the central region of the bucket which must be sufficiently high to clear the truck frame and cylinder 60, may be considered by some people to be undesirable. This hump can be greatly lowered or eliminated altogether by mounting the hydraulic cylinder within the refuse-receiving compartment rather than having the cylinder extending through the loading section. However, this does complicate somewhat the arrangement within the compacting compartment and pieces of refuse must not be permitted to jam the system. However, the cylinder mounted in the compacting compartment provides all of the other advantages itemized above.

While certain preferred embodiments of the invention have been described above, obvious variations in the disclosed structure can be made within the scope of the appended claims.

I claim as my invention:

1. In a self-loading refuse carrier, the combination with a motor vehicle having a compartment adapted to receive and compact refuse therein, of a loading and compacting mechanism comprising:

a pusher-blade extending across a lower portion of said compartment between opposite sidewalls thereof, means for moving said pusher-blade horizontally backward and forward between a refuse-receiving position and a refuse-compacting position, a bucket pivotally mounted along the upper edge of said blade for pivotal movement between a lower refuse-receiving position and an upper refuse-discharging position, at least one cam wheel articulated between the bucket and the blade by means of pivotal arms, and a cam guideway forming an inclined path between a lower refuse-receiving position and an upper refuse-discharging and compacting position, whereby said cam wheel in response to movement of said pusher-blade in a compacting direction travels up said guideway, thereby forcing said bucket to swing from a lower horizontal refuse-receiving position to an upper vertical refuse-discharging position, said bucket in vertical position acting as a vertical extension of the compacting blade with continued movement of the blade in compacting direction.

2. A refuse carrier according to claim 1 wherein the means for moving the pusher-blade comprises a hydraulic cylinder.

3. A refuse carrier according to claim 2 wherein said hydraulic cylinder comprises a single telescopic hydraulic cylinder.

4. A refuse carrier according to claim 3 wherein the hydraulic cylinder is mounted in a central region of the vehicle forwardly of said pusher-blade.

5. A refuse carrier according to claim 1 wherein a pair of inclined guideways are mounted adjacent each side of the vehicle frame and a corresponding pair of cam wheels are articulated between the bucket and blade.

6. A refuse carrier according to claim 4 wherein the bucket includes a high central hump portion extending over the hydraulic cylinder and vehicle frame, said hump portion joining a pair of refuse-receiving pockets which extend below the level of the vehicle frame in refuse-receiving position.

7. A refuse carrier according to claim 1 wherein each cam wheel is mounted for rotation at the lower end of a first arm, the upper end of which is pivotally connected to the bucket and a second arm is pivotally connected between an intermediate portion of said first arm and the pusher-blade.

8. A refuse carrier according to claim 1 which includes a rear door for discharging refuse.

9. A refuse carrier according to claim 8 which includes a refuse-receiving compartment immediately behind the vehicle cab, said compartment being adapted to receive said bucket in refuse-receiving position and having openings in the side walls of the vehicle for receiving refuse.

10. A refuse carrier according to claim 9 wherein said openings are closable by sliding doors.

11. A refuse vehicle comprising a motor vehicle having a cab and a refuse carrying body, said body being enclosed by side walls, a front wall, a top wall and an openable rear door, refuse-receiving openings in said side walls adjacent the forward ends thereof, a loading and compacting mechanism mounted within said body adjacent said refuse-receiving openings, said mechanism including a pusher-blade extending across a lower portion of the body between the sidewalls thereof, a single telescopic hydraulic cylinder mounted centrally in said vehicle forward of the pusher-blade for moving said pusher-blade horizontally backward and forward between a refuse-receiving position and a refuse-compacting position, a bucket pivotally mounted along the upper edge of said blade for pivotal movement between a lower refuse-receiving position adjacent said side wall refuse-receiving openings and an upper refuse-discharging position, said bucket including a high central hump portion extending over the hydraulic cylinder and vehicle frame, which hump portion forms a pair of laterally spaced refuse-receiving pockets, a pair of laterally spaced cam wheels articulated by pivotal arms between the bucket and blade and a pair of cam guideways in the form of inclined ramps mounted laterally adjacent the sides of the vehicle frame whereby said cam wheels in response to movement of said pusher-blade in a compacting direction travel up said ramps, thereby forcing said bucket to swing from a lower horizontal refuse-receiving position to an upper vertical refuse-discharging position, said bucket in vertical position acting as a vertical extension of the compacting blade with continued movement of the blade in compacting direction.

* * * * *